US005640921A

United States Patent [19]

Van Den Haak et al.

[11] Patent Number: 5,640,921

[45] Date of Patent: Jun. 24, 1997

[54] ANCHOR FLUKE

[75] Inventors: Rob Van Den Haak, AC Krimpen; Gijsbertus Degenkamp, EA Voorburg, both of Netherlands

[73] Assignee: Vrijhof Ankers Beheer B.V., Ijssel, Netherlands

[21] Appl. No.: 446,774

[22] PCT Filed: Dec. 1, 1993

[86] PCT No.: PCT/NL93/00257

§ 371 Date: May 31, 1995

§ 102(e) Date: May 31, 1995

[87] PCT Pub. No.: WO94/12386

PCT Pub. Date: Jun. 9, 1994

[30] Foreign Application Priority Data

Dec. 1, 1992 [NL] Netherlands ..... 92 02083

[51] Int. Cl.[6] ..... B63B 21/32

[52] U.S. Cl. ..... 114/301; 114/294

[58] Field of Search ..... 114/294, 301–304, 114/309, 310

[56] References Cited

U.S. PATENT DOCUMENTS

| | | | |
|---|---|---|---|
| 1,838,745 | 12/1931 | Croney | 114/301 |
| 4,704,982 | 11/1987 | Sahlberg | 114/301 |
| 4,781,142 | 11/1988 | Cheung | 114/304 |

FOREIGN PATENT DOCUMENTS

| | | | |
|---|---|---|---|
| 0254033 | 1/1988 | European Pat. Off. . | |
| 0297703 | 1/1989 | European Pat. Off. . | |
| 2365475 | 5/1978 | France | 114/294 |
| 2352144 | 4/1975 | Germany . | |
| 2929495 | 2/1981 | Germany . | |
| 7606300 | 6/1975 | Netherlands . | |
| 7608728 | 2/1978 | Netherlands . | |
| 8400890 | 10/1985 | Netherlands | 114/294 |
| 9303958 | 3/1993 | WIPO . | |

*Primary Examiner*—Edwin L. Swinehart

*Attorney, Agent, or Firm*—Ladas & Parry

[57] ABSTRACT

Anchor fluke comprising a bottom side and an upper side and a longitudinal plane of symmetry, the upper side being defined by two convexly bent faces, formed by faces ascending in a convex manner from the sharp front edge in a symmetrical fashion relative to the longitudinal plane of symmetry twoards the rear and sidewards upto an apex line, by surfaces connecting smoothly thereonto in that location and descending in a symmetrical and convex fashion rearwards and towards the sides.

33 Claims, 6 Drawing Sheets

230
233
228
227
232
221
220
230a
223
222a
222
224
225
214
226
212
210
209
211
213
207
208
206
205
204
203
202
200
234
235
222b
231
230b

ANCHOR FLUKE

BACKGROUND OF THE INVENTION

Field of the Invention

The invention relates to an anchor fluke having having a penetration or front edge and a rear edge, and a longitudinal plane of symmetry intersecting these edges, comprising means for attachment of connecting means to a penetration-anchor line.

SUMMARY OF THE INVENTION

It is an object of the invention to provide an anchor fluke having a stable and favourable penetration behaviour.

It is moreover an object of the invention to provide an anchor fluke and anchor having a great holding force relative to the weight.

It is furthermore an object of the invention to provide an anchor that is very suitable to be included in vertical anchoring systems.

According to the invention an anchor fluke is provided, having a penetration or front edge and rear edge and a longitudinal plane of symmetry intersecting these edges, comprising means for attachment of connecting means to a penetration-anchor line, the fluke having an upper side which, in a portion connecting to the front edge, extends from that front edge according to a convex path which ascends in longitudinal direction and extends there, in both areas of the front portion situated on either side of the longitudinal plane of symmetry, according to paths that ascend in transverse direction in a direction away from the plane of symmetry.

It has been found that an anchor fluke having such a shape can quickly and in a stable manner penetrate to a large depth. Although applicant does not wish to confine himself to that reasoning, he suspects that the stability is aided by the presence on both sides of the longitudinal plane of symmetry of convex faces ascending rearwards and sidewards, so that the soil which moves along the fluke (seen relatively) can exert a reversely outwardly sideward directed force on the upper surface of the fluke, and can readily be pulled into the soil in longitudinal direction as a consequence of the convex shape.

It is preferred that the path which ascends in transverse direction is also convex.

It is preferred that the front edge of the fluke, on both sides of the longitudinal plane of symmetry, has a front edge which runs in an oblique direction towards the front from that plane, said front edge merging in a foremost penetration-point into a side edge which extend substantially along the side of the fluke towards the rear edge. The front portion of the upper side of the fluke herein ascends in a convex manner from the front edges, in a direction substantially perpendicular to the front edges. The sideways and convexly ascending portions herein extend preferably up to a foremost portion of the outer or side edges. Thus it is achieved that a significant part of the front portion of the upper surface of the fluke ascends outwards and sidewards from the longitudinal plane of symmetry, and that on that front portion of the upper surface of the fluke, the surfaces are only directed in two main directions, with a transverse component having an opposite direction which, as is nonetheless supposed, has a stabilising effect and also gives the fluke a smooth shape.

The upper surface of the fluke is preferably shaped in such a way, that the ascending convex front portion of the upper surface of the fluke merges into a convex, descending portion, the rear portion. Thus, the upper surface of the fluke will comprise a portion, which will have hardly any influence on the penetration during penetration of the anchor fluke, that is to say will not hamper this penetration, but will contribute to the weight, and which can be active in a vertical anchoring system after the anchor fluke has penetrated sufficiently.

Vertical anchoring usually takes place with TLP's, by means of tie rods and very expensive piles, for which ever more advanced driving equipment has to be developed as a result of the great water depth. Another possibility is to shoot the anchors into the ground, after which the anchors position themselves horizontally if one exerts a vertical force on them. The solutions required for this purpose have many environmental drawbacks.

As a consequence of the upper surface of the fluke being curved at least in longitudinal cross section, having an apex in the curve which is situated on the upper surface, for instance in the centre of gravity of the surface, the anchor fluke is substantially kept in place when a force in vertical direction is exterted thereon, due to the earth pressure, which will be directed both towards the front and towards the rear.

The convex arch-shape continued in downward direction on the upper/rear side of the fluke, diverging from the plane of symmetry, also contributes to the stabilization of the fluke, both during penetration and during use in a vertical anchoring system.

The top line connecting the ascending and descending convex areas can intersect the longitudinal plane of symmetry preferably in the area of the fluke. Both top lines, each to one side, preferably diverge away from each other forwardly. It is preferred that they intersect the outer or side edges. It is moreover preferred that they slope downwards somewhat from the longitudinal plane of symmetry, while extending outwards and forwards. In this way, the areas of the upper surface of the fluke will be situated relatively highest near the longitudinal plane of symmetry, so that in that location the anchor fluke can have a greatest thickness and as a consequence thereof a greatest strength.

As a result of these measures, the upper surface of the fluke will slope downwards in the area near the edge between the point of intersection of the top line and the side edge and the point of the greatest width. The lower surface of the upper side of the fluke will then offer a surface area to the soil that is directed forwards and is ascending. Actually, a stabilizer is hereby provided as described in European patent specification no. 049.455 in the name of applicant.

The anchor fluke according to the invention preferably comprises a bottom side, having a convex course in transverse cross section, that is of which the concave side is directed downwards. Thus, the anchor fluke is given a twin plated, forwardly bending shape in longitudinal cross section, which is particularly advantageous for the penetration behaviour.

It is preferred that the bottom side of the fluke extends in rearward direction beyond the upper side of the fluke in order to thus form a slopingly upwardly and rearwardly directed flat plate stern. This prevents the formation of too great an underpressure near the upper rear edge of the fluke, which underpressure would otherwise bring about an upwardly tilting moment in forward direction. Moreover, a flat plate stern having such an orientation is advantageous in vertical anchoring systems, because the flat plate stern then presses against a body of soil situated above it and thus contributes to the holding force of the anchor in the vertical anchoring system.

In other words, the invention relates to an anchor fluke, comprising a bottom side and an upper side and a longitudinal plane of symmetry, the upper side being defined by two convexly bent surfaces, formed by surfaces ascending in a convex manner from the sharp front edge in a symmetrical fashion relative to the longitudinal plane of symmetry towards the rear and sidewards up to an apex line and by surfaces connecting smoothly thereonto in that location and descending rearwards and sidewards in a symmetrical and convex fashion. Herein the front edge is preferably V-shaped, while the front edge and the connecting front portions of the outer edges, can together define a W-shape in top view.

It is remarked that from Dutch patent application 76.08728 an anchor is known, which is particularly suitable for anchoring in muddy soil and is provided with a shank structure formed by a number of rods and with a fluke which, seen in vertical longitudinal cross section, has a convex shape at the top and at the bottom. Seen in transverse cross section, however, this fluke runs straight on the upper and on the bottom side. In order to provide the known anchor with sufficient course stability, stabilizer plates have been arranged for that purpose on both sides of the fluke. Although these plates function satisfactorily, they also increase resistance against anchor penetration.

It is further remarked that from U.S. patent specification 4.781.142 an anchor is known, comprising a rigid shank and a fluke, wherein the fluke comprises two fluke halves situated on both sides of the longitudinal plane of symmetry, each tapering, from rear to front, both in transverse and in downward direction to a front point. The fluke halves are herein composed of a number of flat plate members, merging into one another via sharp lines or buckle lines, so that the fluke halves have an angular appearance in transverse cross section. On the rear ege of the fluke the fluke halves end with their rearwardly ascending surfaces in a cross-plate, projecting in sidewards direction from the upper surface and thus forming stabilizer surfaces. These surfaces which are perpendicular to the direction of penetration hamper the penetration of the anchor.

The application moreover relates to an anchor comprising a fluke and a shank, formed by at least one pair of wires, lines or stays, such as cables or chains, attached onto the fluke with their lower ends at locations which are spaced from each other in longitudinal direction of the fluke and being connected to a coupling mechanism with their upper end at locations spaced from each other, said coupling mechanism being itself provided with means for connection to a penetration-anchor line, the coupling mechanism being provided with means, operated by remote control, for displacing or adjusting the upper ends of the shank wires relative to each other.

The advantage of such an anchor is that the non-rigid shank, and with it the penetration-anchor line, can be adjusted under several angles relative to the penetrated fluke. When the anchor, after having served it purpose, is no longer required at a certain location and when it is desirable the use the same anchor at a different location, the angle between shank and fluke may be enlarged and the penetration-anchor line, which has also been used for the anchoring, can be brought into for instance a more vertical position, in which a tensile force exterted on the anchor line results in the fluke moving in an obliquely upwards direction through the anchoring soil, until the fluke leaves the anchoring base. It will also be possible, after penetration of the fluke in the anchoring base, to swing the shank wires and with this the shank relative to the fluke in such a way, that the fluke is suitable to take part in a vertical anchoring system. For this purpose the fluke need not be adapted, yet some provisions need to be made between the upper ends of the shank wires and the lower end of the penetration-anchor line, that is to say in the coupling mechanism.

The anchor preferably comprises a coupling mechanism, having a movable connecting member, such as one or more oblong, parallel plates, wires or chains, to which the upper ends of both shank wires have been secured and comprising displacement means for swinging the connecting member in a vertical plane.

The operatable means preferably comprise two flexible connecting lines of unequal length, being connected with their lower ends to the connecting member at locations that are spaced from each other, and being connected with their upper ends to a coupling member at locations that are displacable relative to each other in direction of pull by means of remote control means, said coupling member being itself connected with its upper end to the lower end of the penetration-anchor line.

The coupling member herein preferably comprises two or more female spaces or seats, which open substantially in the direction of pull, away from the fluke, and are spaced in direction of pull and in which a male member, such as a pin or cam, situated on or near the upper end of the longest connecting line, may come to rest in a removable manner, the operating means being adapted to control the position of the male member.

The remote control means can comprise an auxiliary line, put around a pin, to be put into the seat by means of for instance a thimble.

An advantageous, compact and simple embodiment of the coupling mechanism according to the invention is one in which the movable connecting member comprises a first connecting part and a second connecting part, being hingedly connected to each other on one end and being connected to each other on their other end by means of a connection which can be disconnected by means of remote control means, the first connecting part being provided with the means for connection with the penetration-anchor line and the second connecting part being provided with means, being spaced from each other, for connection with the upper ends of the shank wires. By disconnecting the two connecting parts on their one end they can, under continued pull on the penetration anchor line, as it were swing open relative to each other into for instance a mutual angle of 180°. During this movement, the location of the means for connection with the upper ends of the shank wire will be interchanged and thereby the angle of the shank relative to the fluke.

Preferably, the first connecting part and/or the second connecting part are herein formed by an oblong plate or plates.

Preferably, the disconnectable connection is formed by a tenon and mortise connection, the tenon being connected to the lower end of an auxiliary line. By simply pulling the auxiliary line, the tenon is removed from the connection and the first and second connecting parts can jump open.

In order to have more possibilities in the choice of the shank angle prior to paying out the anchor, the second connecting part is preferably provided with more than two interspaced means for connection with the upper ends of the shank wires.

BRIEF DESCRIPTION OF THE DRAWINGS

The invention will now be described in more detail on the basis of the embodiments of an anchor fluke according to the invention and the coupling mechanism according to the invention, both shown in the acconpanying figures and both serving merely as examples. The following is shown in.

DESCRIPTION OF THE PREFERRED EMBODIMENT

Figure 1:
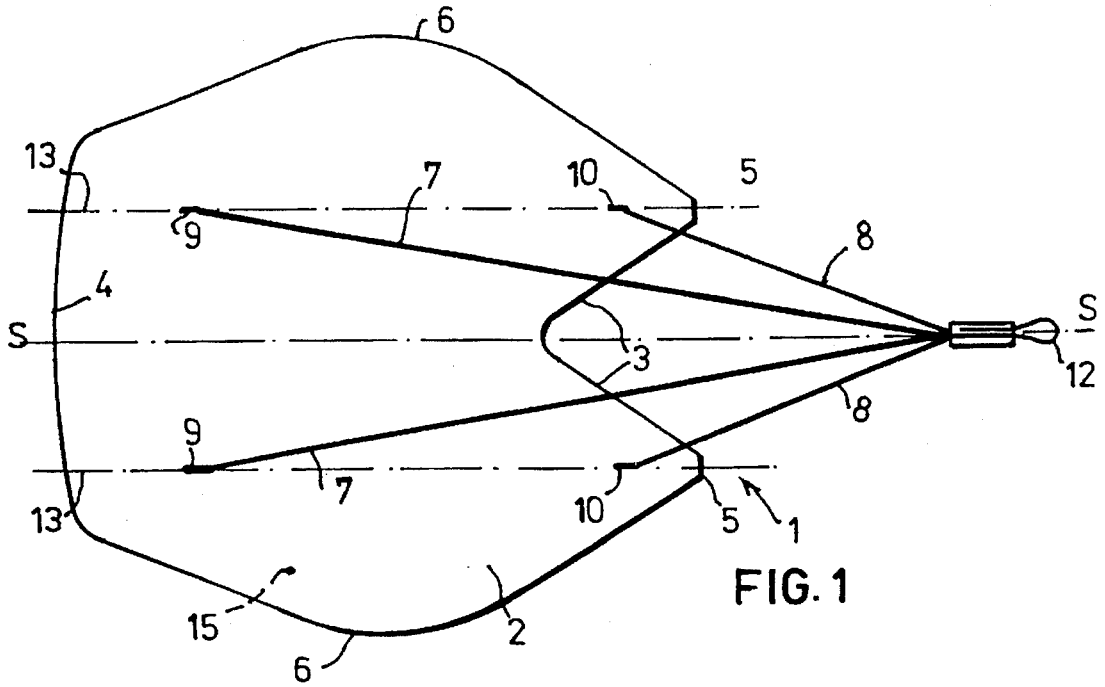
FIG. 1: a top view of an exemplary embodiment of an anchor fluke according to the invention, provided with a shank made up of wires.

FIG. 1 shows an anchor 1 according to the invention, having a fluke 2, comprising a front edge 3 and a rear edge 4 and side edges 6, which edges form the boundaries for the upper plate 14. A bottom plate 15 is situated on the bottom side. It is remarked that these plates need not be formed as a whole, but may be composed of several plate members. The fluke 2 is reinforced by means of two longitudinal girders 13 represented by dashed lines, said longitudinal girders running from the rear edge 4 to the front edge 3, and ending on the front edge in penetration points 5. The retracted front edge 3 of the fluke 2 is V-shaped, the tip of the V being directed towards the rear, so as to provide the penetration points 5.

The anchor 1 moreover comprises a shank built up of two pairs of wires 7, 8, attached to the fluke 2 at locations 9 and 10, respectively. On their other end, the wires 7, 8 are joined together at connecting member 11, to which an attaching eye 12 is also secured to which a penetration-anchor line (not shown) can be attached to let the anchor penetrate into the soil.

The fluke 2 represented in FIG. 1 is symmetrical relative to the longitudinal plane of symmetry S, said plane extending perpendicular to the plane of the drawing.

Figure 2:
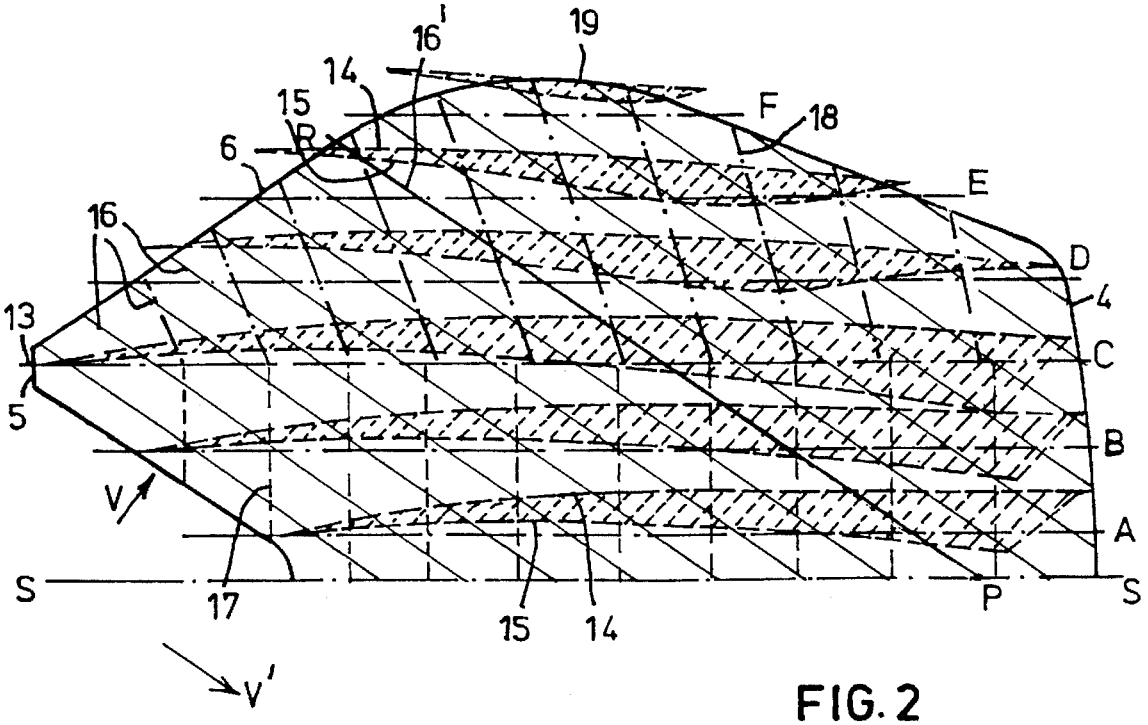
FIG. 2: a top view on an exemplary embodiment of the anchor fluke according to the invention, wherein at a number of locations, the vertical longitudinal cross sections have been shown, as well as the bending lines for the upper surface and the bottom surface of the anchor fluke.

In FIG. 2 one of both symmetrical halves of the fluke 2 of FIG. 1 is depicted, wherein the vertical longitudinal cross sections in the planes A, B, C, D, E and F extending parallel to the longitudinal plane of symmetry S have been schematically represented.

Furthermore, FIG. 2 shows the bending lines or generatrices of the upper plate 14 and the bottom plate 15. The generatrices of the upper plate 14 are indicated with reference numeral 16, the highest generatrice 16' intersecting the side edge of the upper plate 14 at R and intersecting the longitudinal plane of symmetry S at location P. In FIG. 2, the generatrices 16 extend parallel and are positioned on a cylinder surface, although this is not strictly necessary. It can be seen that at the front the generatrices coincide with the front edge 3, so that the portion of the upper plate 14 situated between the line RP, the side edge 6, the front edge 3 and the longitudinal plane of symmetry S is curved upwards in the direction V, perpendicular to the front edge 3. This front area of the upper plate 14, together with the corresponding area of the other half of the fluke, forms a striking plane for the soil during penetration of the anchor, said meeting plane ascending convexly and diverging in two directions V, V'.

In the rear area, bounded by the line RP, the plane of symmetry S, the rear edge 4 and the side edge 6, the upper plate 14 continues to curve downwards in a convex manner and sidewards in the direction V. As a result, not only the stability during penetration is further improved, but the lateral stability of the anchor fluke during use in vertical anchoring systems is enhanced.

In FIG. 2 it can be seen that at the location of the point R the side edge 6, seen from left to right in the drawing, merges from a upwardly curved course into a downwardly curved course. As a consequence, an area on the bottom side of the upper plate 14, bounded by the side edge 6, situated in the direction of penetration behind the point R, may form a surface that is oriented downwards and in the direction of penetration. This will be discussed in more detail below.

In FIG. 2 moreover, the generatrices of the bottom plate 15 have been indicated. Herein, two areas can be distinguished, namely the central area between both longitudinal girders 13 and the area to the sides of and outside the longitudinal girders 13.

In the area between the longitudinal girders, seen (for the half of the fluke represented in FIG. 2 that is the area on the drawing below the longitudinal girder 13), the bottom plate 15 is bent only in longitudinal direction. The generatrices or bending lines 17 are therefore positioned perpendicular to the plane of symmetry S and to the longitudinal girders 13.

In the greater part of the area outside the longitudinal girders 13 the bottom plate 15 is bent convexly both in longitudinal direction and in transverse direction. The bending lines or generatrices 18 herein define an angle with the longitudinal plane of symmetry S which is larger than that of the bending lines 16 of the upper plate 14. In this outer area of the bottom plate 15, a transition takes place in the direction of bending in the rear area, so as to achieve that the portion of the side edge 6, behind the point of the largest width, point 19, is sharp. It can be seen that the upper plate 14 and the bottom plate 15 meet along the front edge 3 and the side edge 6 so as to form a sharp edge, which promotes penetration.

As has already been indicated above, the upper plate 14 extends downwards in rearward direction in the edge area behind point R, and it can be seen that, between the area bordering on the side edge 6, between points R and 19, starting from the sharp side edge 6 and from a convexly bent course of the bottom plate 15, the bottom plate 14 forms a plane directed downwards and towards the front, which plane may serve as a stabilizer.

Figure 3:
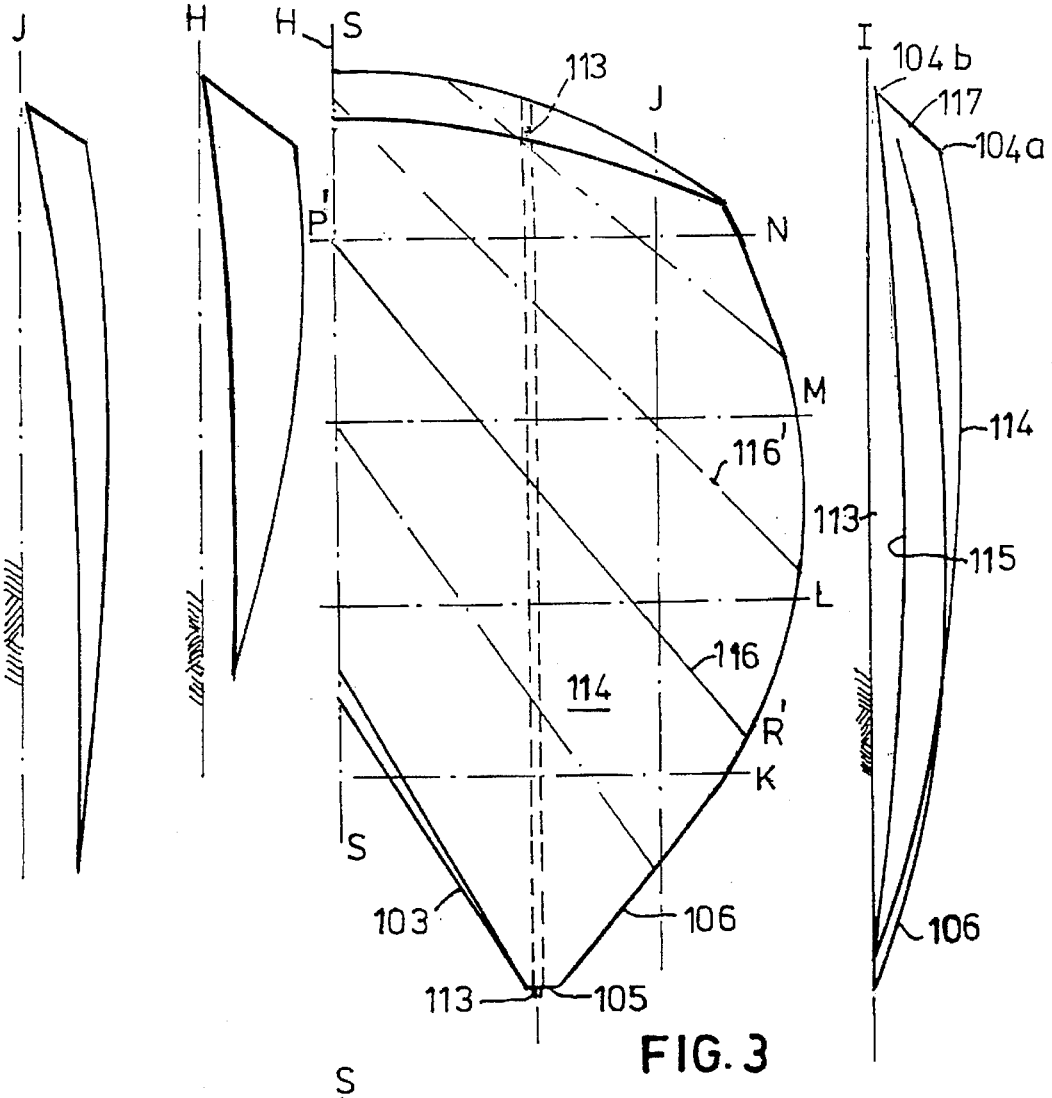
FIG. 3: a top view on one half of a further exemplary embodiment of the anchor fluke according to the invention, wherein some bending lines and some longitudinal cross sections have been represented.

FIG. 3 shows a somewhat altered shape of the anchor fluke according to the invention. Again, one of the symmetrical halves of the fluke 102 is shown. The fluke 102 has a front edge 103, a side edge 106 and upper rear edge 104*a* and bottom rear edge 104*b*, the front edge 103 and the side edge 106 meeting at the front in penetration point 105. The upper rear edge 104*a* is situated forwards from the bottom rear edge 104*b*, so that a flat plate stern 117, extending slopingly upwards, is formed, which can contribute to the holding force of the fluke in vertical anchoring systems. Moreover, this position of the flat plate stern improves the penetration behaviour. A longitudinal girder 113 extends towards the back from the penetration point 105, parallel to the the longitudinal plane of symmetry S. Depicted are the generatrices or bending lines 116 of the top plate 114. The highest bending line 116' extends between the point of intersection with the longitudinal plane of symmetry S, P', and the point of intersection of that line with the side edge 106, R'. In the area situated in front of the line P' R' in the direction of penetration, the upper surface of the fluke 102 is shaped in a convexly curved manner both inwards and towards the front. At the front edge, the lines 116 coincide with the front edge 103 and they subsequently, going towards the rear, do not extend parallel, but in this example are situated on a conical surface, the centre line of which is located in a plane which is perpendicular to the plane of the drawing and extends from an area to the right below the plane of the drawing to an area to the left above the plane of the drawing. The point P' is situated higher than the point R'. The upper plate 114 therefore has its greatest height at the location of the point P'.

FIG. 3 also shows some vertical longitudinal cross sections, namely along the faces H, I and J. The face H coincides with the plane of symmetry S and the face I comprises the longitudinal girder 113. In the longitudinal cross sections it is special that herein the position is shown, which is taken up by the fluke when it is placed on a flat base. The fluke is then resting with its rear edge 120 of the bottom plate 115 and the penetration point 105, as well as the longitudinal girder 113 on the flat base. This can be seen clearly in cross section I. The longitudinal cross sections clearly show the smooth and sharp appearance of the fluke according to the invention. In cross section H, the great distance can be seen between the upper plate 114 and the bottom plate 115 near the point P'. Moreover, it can also be seen that the rear side is cut off, to define a flat plate stern 117 between the edges 104*a* and 104*b*. In cross section I, the course of the side edge 106 has also been shown by way of illustration.

Figure 4:
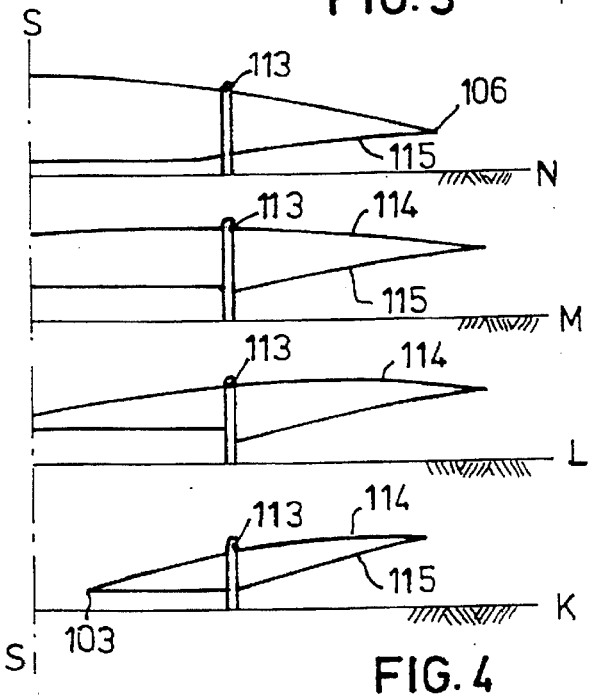
FIG. 4: shows a number of transverse cross sections according to the lines indicated in FIG. 3.

The bottom plate 115 is always formed in a concavely curved manner in longitudinal direction, and in transverse direction substantially in accordance with the bottom plate 15 shown in FIG. 2. In FIG. 4, this has been further illustrated by means of transverse cross sections K, L, M and N. These cross section are taken along faces perpendicular to the plane of the drawing of FIG. 3.

The straight course in transverse cross section of the bottom plate 115 in the area between the plane of symmetry S and the longitudinal girders 113 can be seen clearly. In the area outside the longitudinal girders 113, the bottom plate 115 is bent concavely in a smooth manner to meet the upper plate 114 in a sharp side edge 106.

In cross section K, the convexly curved shape, ascending laterally, of the upper plate 114 can be seen clearly.

The point of the convexly curved bottom side is that the anchor now rest on the ground at the front and at the rear and that the tip thereof is as it were thrust into the ground when the anchor is pulled. At the rear, the upper plate of the anchor descends outwardly in a curved manner to form stabilizer faces, and thereby provides dynamic penetration stability.

Because the fluke has been given a highly streamlined shape and because no separate stabilizers are present to prevent the penetration, the anchor fluke according to the invention has very good penetration characteristics. Added to that, a fixed shank is also lacking in the anchor equipped with the anchor fluke according to the invention (as shown in FIG. 1), a relatively light anchor is provided in comparison with the obtained surface of the fluke. Although this anchor is light, it will nevertheless be able to provide a great holding force, especially when used in vertical anchoring systems.

In general, it can be said that such an anchor, as a consequence of an almost identical curve in longitudinal direction of the upper plate and the bottom plate, with almost no further resistance from stabilizers and shanks, will continuously tend to continue in that same curve during penetration, counter to the negative tensile forces of the penetration anchor line. Stability is herein promoted by the front portion of the upper side of the fluke, namely the upwardly and convexly curved surfaces which run away from each other, and the rear portion of the upper face of the fluke smoothly connecting thereto, where the convexly curved surfaces run downwards and away from each other.

Figure 5:
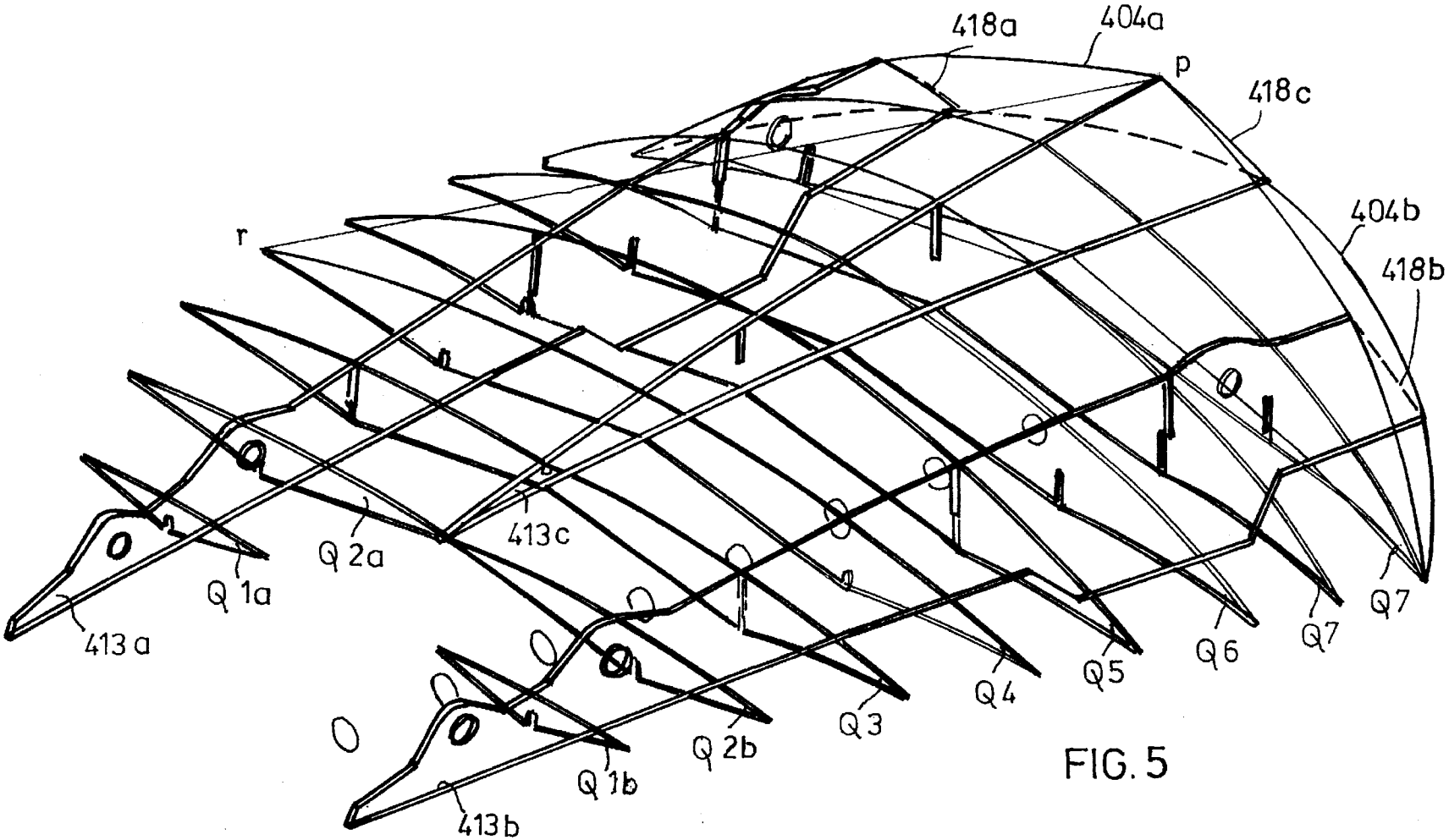
FIG. 5: a girder and sleeper diagram of an embodiment of an exemplary embodiment of the anchor fluke according to the invention.

In FIG. 5, the frame of a preferred embodiment of the fluke according to the invention has been represented. The girders 413*a, b* are herein arranged in a manner somewhat converging in forward direction. On the front, two sleepers Q1*a* and Q1*b* are connected to the girders 413*a, b*. Behind that, two sleepers Q2*a* and Q2*b* are arranged, attached with their inner ends to the front end of the middle girder 413*c*. The middle girder 413*c* is situated in the plane of symmetry of the fluke. Further towards the back, sleepers Q3, Q4, Q5, Q6, Q7 and Q8 are arranged successively at equal distances from each other, and at the rear side the face of the flat plate stern 417 is shown schematically, attached onto the oblique end edges 418*a*, 418*b* and 418*c* of girders 413*a*, 413*a* and 413*c*, respectively. It should be understood that the upper side and the bottom side of the fluke are formed by curved or slightly buckled plates, which are attached against the upper edges and the lower edges of the sleepers, respectively, and therefore follow the course thereof in transverse direction. The relatively strong curve of the portion behind the top line pr, behind which the rear portion, bent towards the rear and sidewards, of the upper face of the fluke will be situated, can be seen clearly. It can moreover be seen that in areas in the plane of symmetry which are situated more towards the rear, both halves of the upper surface meet according to a discontinuity. It can also be seen that, in the central area of the bottom side, as a consequence of the shape of the lower edge of the sleepers, the bottom surface of the fluke will extend somewhat downwards from the middle in lateral direction, so as to improve stability.

Figures 6A, 6B, 6C, 8A, 8B, 8C:
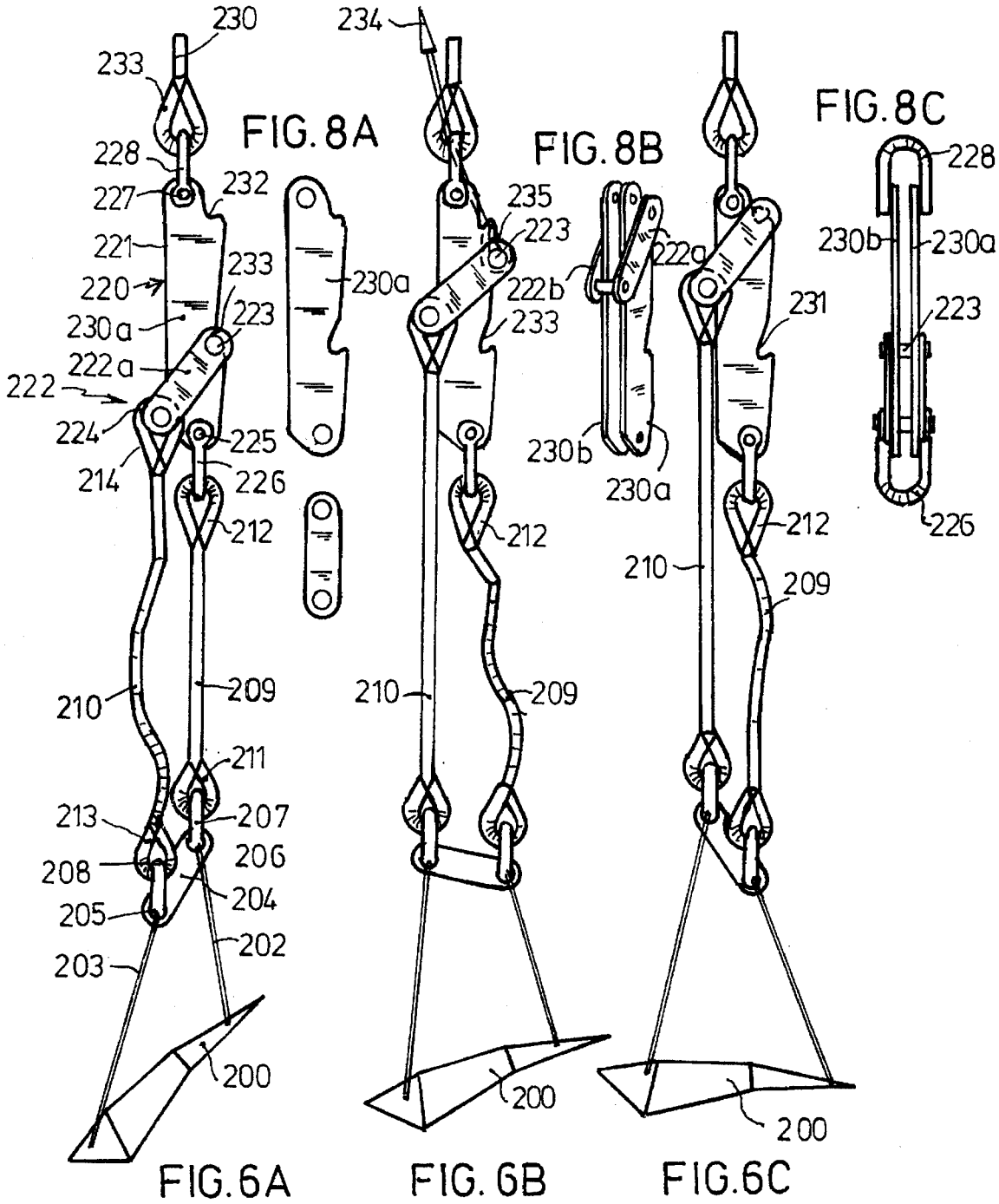
FIG. 6A–C: the starting position, the intermediate position and the final position of a coupling mechanism according to the invention, with which the angle of a stay shank may be changed relative to an anchor fluke.
FIG. 8A–8C: some views of the coupling member of the example of a coupling mechanism according to the invention represented in FIGS. 6A–6C.

FIGS. 6A–6C show the mechanism according to the application by which, in case of a penetrated fluke, the shank angle relative to the fluke can be altered by means of remote control. The anchor as shown here comprises a fluke 200, to which a pair of front shank cables 202 and a pair of rear shank cables 203 have been attached with their lower ends. The upper ends 205 and 206 of the pairs of shank wires 202 and 203, forming the non-rigid shank 201, are rotatably attached to a connecting plate 204. This connecting plate 204 is provided with two eyes, in which two shackles 207 and 208 have been secured. The upper ends 205 and 206 of the shank cables 202 and 203 can be attached to the pins of these shackles by means of thimbles. The lower ends 211 and 213 of parallel connecting cables 209 and 210 are attached to the shackles 207 and 208. The connecting cable 210 is herein longer than the connecting cable 209.

A coupling member 220 is situated above the cables 209 and 210, said coupling member comprising a plate assembly 221 and a movable coupling element 222. The plate assembly 221 comprises two parallel plates 230*a*, 230*b* (see also FIGS. 8A–8C) and is provided with seats or notches 232 and 233, situated at a distance of each other in the direction of pull or anchor line main direction. On the bottom side of the plate assembly 221 the thimble 212 is attached to the upper end of the connecting line 209 by means of a pin 225 and shackle 226. The lower end of the penetration-anchor line 230, in the shape of thimble 231, is attached to the upper end of the plate assembly 221 by means of pin 227 and shackle 228.

The displacable coupling member 222 here consists of two parallel plates 222*a* and 222*b*, connected to each other by means of an upper pin 224 and a lower pin 223. The distance between these two pins 223 and 224 is such, that the coupling member 222 can shift over the plate assembly 221. On its upper end, the connecting cable 210 is attached with thimble 214 to the pin 223 and thereby to the coupling member 222.

FIG. 8A shows the plate assembly 221 and the coupling member 222 separately in side view. In FIG. 8B, both parts are shown in perspective, but now in the position, in which the coupling member rests in the seat 232. FIG. 8C provides a front view of both parts with shackles, the coupling member resting in the seat 233.

In the situation represented in FIG. 6A, the upper pin 224 of the coupling member 222 rests in the lower seat 231 and, as a consequence of the ratio in length between the connecting cables 209 and 210, only the connecting cable 209 is taut. The tensile force is consequently transferred from anchor line 230, to the plate assembly 221, to connecting cable 209 and from there to the connecting plate 204. In FIG. 6A, the anchor has a configuration in which it is suitable to be pulled into sandy soils. The situation in FIG. 6A will thus occur during penetration. For this purpose, reference can also be made to the sketch of FIG. 7, in which it can be seen how the fluke 200 is pulled into the soil 300 by the penetration-anchor line 230, along the path 301. On the right-hand end of this path 301 the situation shown in FIG. 6B has been achieved. Then, the auxiliary cable 234 is pulled, of which the lower end 235, in this case a thimble, is attached to the pin 223 of the coupling member 222. By pulling the auxiliary cable 234, for instance from the object to the anchored or from an auxiliary vessel, the pin 223 will be pulled up out of the seat 233 and can then be pulled up along the side edges of the plates 230*a*, 230*b* into seat 232. The auxiliary cable 234 is herein advantageously guided by the shackle 228. When the pin 224 is moved upwards, the coupling member 222 will be moved upwards over and around plate assembly 221 and thereby also the pin 223. As a result, the connecting cable 210 will become taut and exert a tensile force on, seen in the drawing, the left-hand portion of the connecting plate 204, so that the latter will twist clockwise. Herein a tensile force is also exerted in the rear shank cables 203, so that the fluke will also be rotated clockwise, which has been schematically represented on the right-hand side of figure 7.

Figure 7:
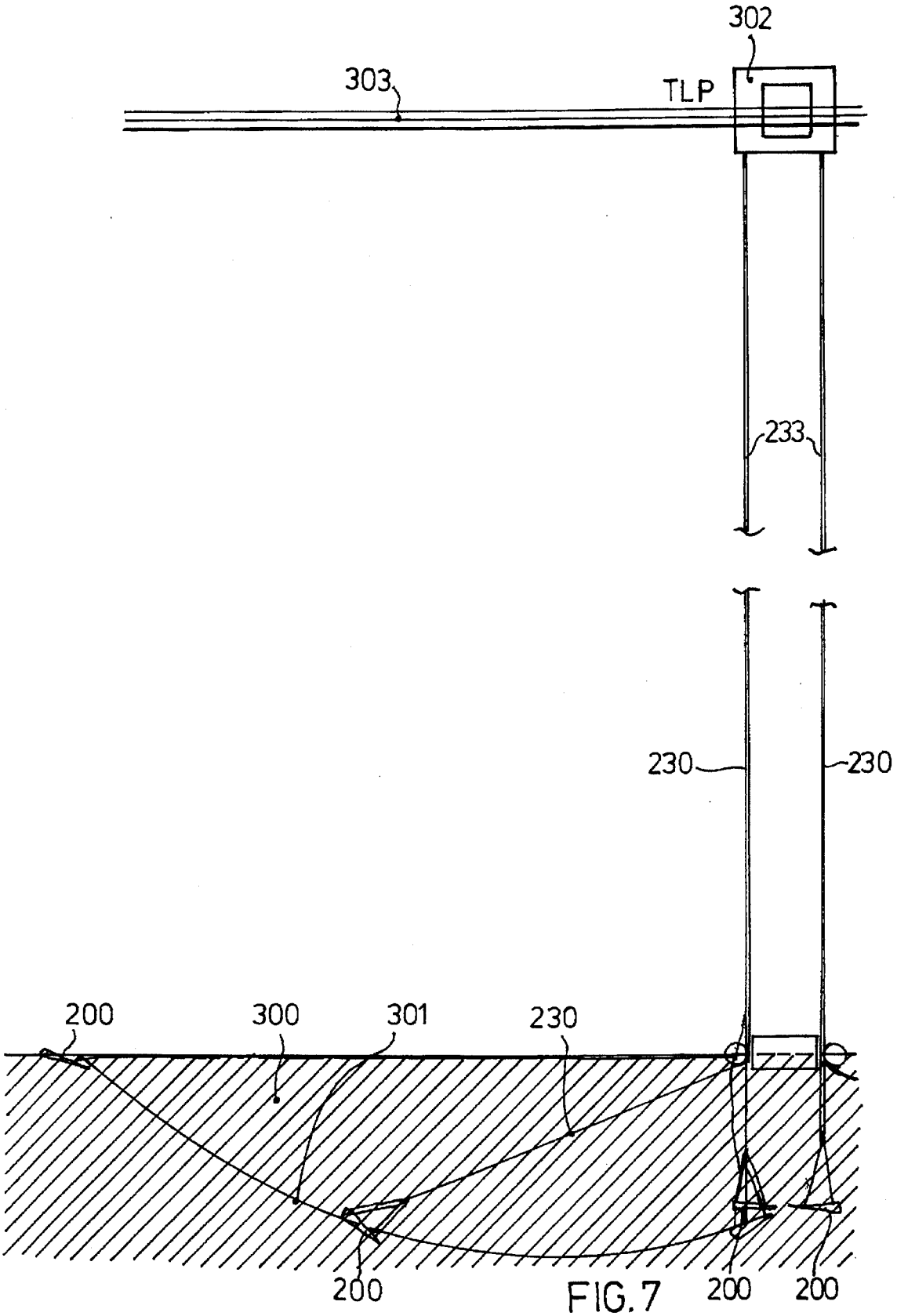
FIG. 7: a schematic representation of the penetration of a fluke and the adjustment thereof for a vertical-anchoring system for a TLP, wherein use can be made of the coupling mechanism of FIGS. 6A–6C.

Finally, the situation represented in FIG. 6C is achieved, in which the pin 223 has come to rest in the seat 232 and the fluke has attained an ideal position for a vertical anchoring system as in FIG. 7 for the TLP 302. By means of the cables 230, the TLP 302 is pre-tensioned relative to the water-level 303.

If desired, the pin 224 can also be connected to an auxiliary line, extending to the floating object. By means of this auxiliary line, not shown, the coupling member 222 may be lifted on the left-hand side, after the anchor line 230 has been relaxed somewhat, in order to achieve the exit of the pin 223 out the seat 232, the result of that being that the pin 224 is once again brought into the seat 233 by means of the tensile force exerted on the anchor line 230. In this position, pulling the fluke 200 out of the soil is made easier.

Figure 9B:
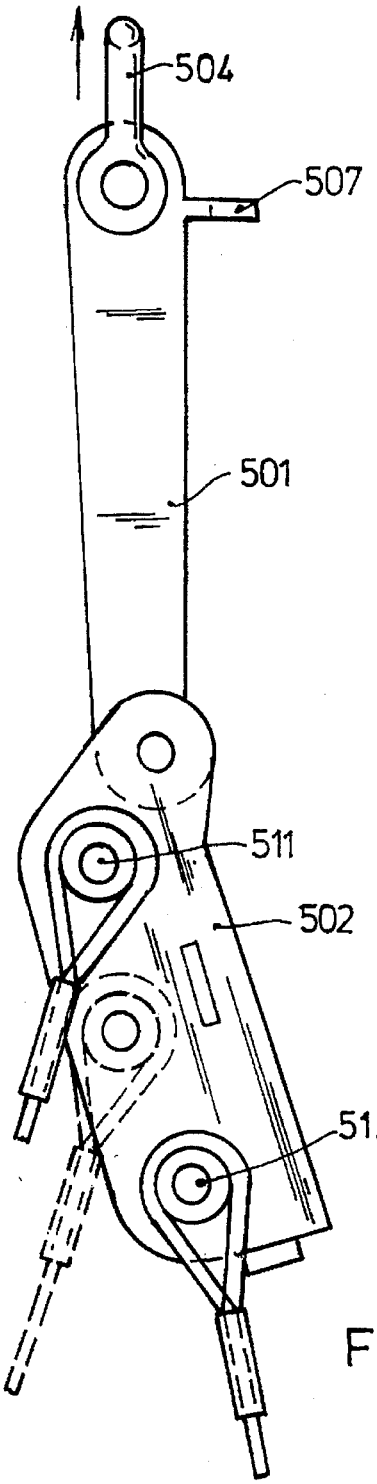
FIG. 9A and 9B: the folded and the extended position, respectively, of an alternative embodiment of the coupling mechanism according to the invention.
Figure 9A:
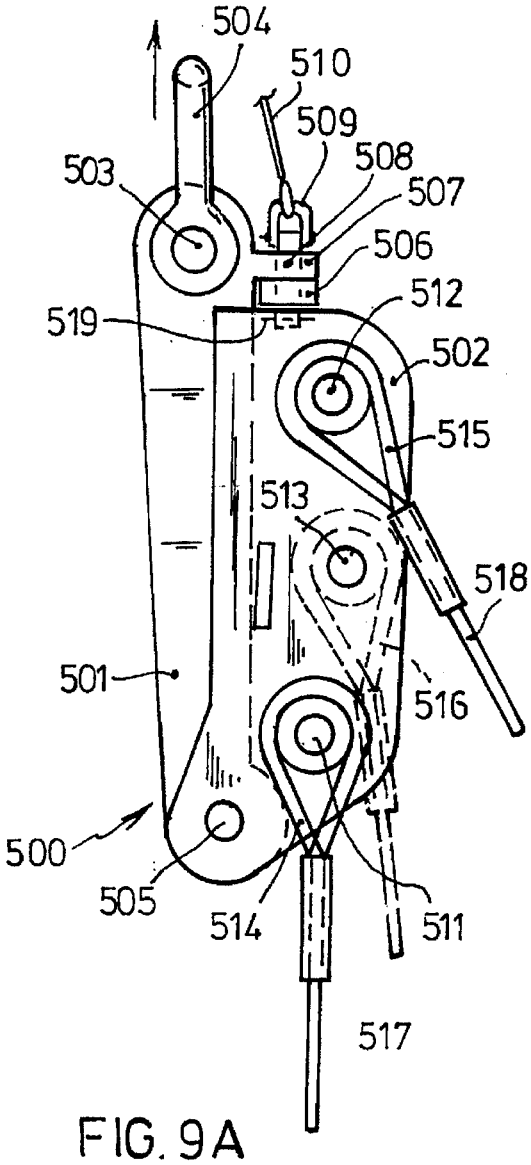

In FIGS. 9A and 9B, an alternative embodiment of the coupling mechanism according to the invention has been shown. The coupling mechanism 500 is herein formed by an oblong plate 501 and two parallel plates 502, hingeably connected to each other by means of hinges 505. The plate 501 herein fits between both plates 502. The depiction of FIG. 9A should be considered as a midsection.

On the upper end the plate 501 is connected to shackle 504 by means of pin 503, a penetration anchor line being attached to said shackle. On that same end, the plates 501 and 502 are also attached to each other, by means of an eye pin 508 projecting through a hole in transverse plate 506, which transverse plate connects both plates 502, and a hole provided in a transverse plate 507 in a plate 501, said eye pin being secured with breaking pin 519. A shackle 509 is attached to the eye of eye pin 508, to which shackle in its turn the thimble-shaped lower end of auxiliary line 510 is attached.

Both plates 502 are also connected to each other by means of transverse pins 511, 512 and 513. Thimbles 514 and 515 have been placed around two of these transverse pins, which are therefore confined in lateral direction by both plates 502. Thimble 514 is the upper end of shank wire 517 and thimble 515 is the upper end of shank wire 518. It will be understood that these shank wires represent pairs of shank wires and are attached at the front and the rear respectively of the fluke of the anchor (not shown).

When now, after sufficient penetration of the anchor, the auxiliary line 510 is pulled, the pin 508 will be pulled out of the holes in the parts 506 and 507, as a result of which the connection present on that end of the plates 501 and 502 will be released. A tensile force exerted in the direction of the arrow in FIG. 9A by the penetration-anchor line on the shackle 504 will result in the breaking of the breaking pin 510 and in the plates 501 and 502 moving away from each other around hinge 505. Finally, the situation represented in FIG. 9B is achieved, in which the transverse pin 511 and therewith the thimble 514 are now situated higher than the transverse pin 512 and the thimble 515.

We claim:

1. In an anchor fluke having a front edge for penetration a rear edge and a longitudinal plane of symmetry intersecting these edges in a longitudinal direction, the improvement of said anchor fluke comprising:

an upper side including a front portion situated on either side of said longitudinal plane of symmetry, said front portion extending along said longitudinal direction away from said front edge according to a convex path that ascends in said longitudinal direction, said front portion further extending in a transverse direction away from said longitudinal plane of symmetry according to a path that ascends in said transverse direction;

wherein, on said either side of said longitudinal plane of symmetry said front edge has a front edge portion that runs from said longitudinal plane of symmetry in an oblique direction farther from said rear edge, said front edge portion merging at a foremost penetration point into a side edge that extends towards said rear edge substantially all along a side of said anchor fluke.

2. The anchor fluke according to claim 1, wherein said front portion ascends in both transverse directions according to a convex path.

3. The anchor fluke according to claim 1, wherein the front portion of the upper side of the fluke ascends in a convex manner from the front edge portions, in a direction substantially perpendicular thereto.

4. The anchor fluke according to claim 3, wherein the front portion of the upper side extends up to a foremost portion of the side edges.

5. The anchor fluke according to claim 1, wherein the front portion of the upper side of the fluke ascends in a convex manner from the front edge portions in two rearwardly diverging directions, in a symmetrical manner relative to the longitudinal plane of symmetry.

6. The anchor fluke according to claim 1, wherein each said front portion merges into a descending convex rear portion of said upper side via a top line, said top lines extending from a point of intersection which is situated in said longitudinal plane of symmetry.

7. The anchor fluke according to claim 6, wherein the top lines extending on both sides of the longitudinal plane of symmetry intersect at a point situated on the fluke.

8. The anchor fluke according to claim 6, wherein the top lines extending on either sides of the longitudinal plane of symmetry slope downwards from the plane of symmetry.

9. The anchor fluke according to claim 6, wherein both top lines situated on both sides of the longitudinal plane of symmetry diverge from each other towards the front.

10. The anchor fluke according to claim 6, wherein both top lines extending on both sides of the longitudinal plane of symmetry intersect outer or side edges of the fluke.

11. The anchor fluke according to claim 10, wherein the side edges are curved so that the fluke, going from the front edge towards the rear edge, first becomes wider until a maximum width and then becomes narrower towards the rear edge, the top lines extending on both sides of the longitudinal plane of symmetry intersecting the outer or side edges at a point situated in front of the maximum width.

12. The anchor fluke according to claim 1, further comprising a bottom side extending substantially correspondingly to the upper side in longitudinal cross section.

13. The anchor fluke according to the claim 12, further comprising two longitudinal girders, arranged on both sides of the longitudinal plane of symmetry, wherein in the area between the longitudinal girders, the bottom side of the fluke has concave course in transverse cross sections.

14. The anchor fluke according to claim 13, wherein, in the areas outside the longitudinal girders, at least a front portion of the bottom side of the fluke has a concave course in longitudinal direction and a sideways outward direction.

15. The anchor fluke according to claim 13, wherein generatrices or the bending lines of the area of the bottom side of the fluke situated outside the longitudinal girders are at a sharp angle relative to the longitudinal plane of symmetry, said angle being larger than the corresponding angle of the bending lines of the upper side of the fluke in the portion situated above it.

16. The anchor fluke according to the claim 12, wherein the bottom side having a concave course in the transverse cross sections.

17. The anchor fluke according to claim 1, wherein the bottom side of the fluke extends in rearward direction beyond the upper side of the fluke to form a slopingly upwardly and rearwardly extending flat plate stern.

18. The anchor fluke according to claim 1, further including means for attaching the fluke to a penetration-anchor line.

19. Anchor fluke comprising a bottom side, an upper side having a front edge, a rear edge and side edges, and a longitudinal plane of symmetry, the upper side being defined by two convexly bent surfaces which are located on either side of said plane and are each formed by first surfaces ascending in a convex manner from a sharp front edge in a symmetrical fashion relative to said plane towards the rear and sidewards up to an apex line and by second surfaces connecting smoothly to said first surfaces in that location and descending in a symmetrical and convex fashion rearwards and outwards, towards the sides.

20. The anchor fluke according to claim 19, wherein the front edge is shaped like a V opening forwardly.

21. The anchor fluke according to claim 20, wherein the front edge and the connecting front portions of the outer edges define a W-shape.

22. Anchor, comprising a fluke and a shank, said shank formed by at least one pair of wire means and attached onto the fluke with their lower ends at locations which are spaced from each other in longitudinal direction of the fluke and said wire means being connected to a coupling mechanism with their upper end at locations spaced from each other, said coupling mechanism being provided with means for connection to a penetration anchor line, the coupling mechanism being provided with means, operable by remote control, for displacing or adjusting the upper ends of the shank wire means relative to each other.

23. The anchor according to claim 22, wherein said coupling mechanism further includes a movable connecting member having one or more oblong parallel plates to which the upper ends of both shank wire means have been secured, and displacement means for swinging the connecting member in a vertical plane.

24. The anchor according to claim 23, wherein the displacement means comprises two flexible connecting lines of unequal length, being connected with their lower ends to the connecting member at locations that are spaced from each other, and being connected with their upper ends to a coupling member at locations that are displacable relative to each other in direction of pull by means of a remote control means, said coupling member being itself connected with its upper end to the lower end of a penetration anchor line.

25. The anchor according to claim 24, wherein the coupling member comprises two or more female spaces or seats, which open substantially in the direction of pull, away from the fluke, and are spaced in direction of pull and in which a male member that is situated on or near the upper ends of the longest connecting line, may come to rest in a removable manner, the remote control means being adapted to control the position of the male member.

26. The anchor according to claim 25, wherein the control means comprises an auxiliary line arranged by means of a thimble around the male member, which is to be put into the female spaces or seats.

27. The anchor according to claim 23, wherein the movable connecting member comprises a first connecting part and a second connecting part, being hingedly connected to each other on one end and on their other ends being connected to each other by means of a connection which can be disconnected by means of remote control means, the first connecting part being provided with the means for connection with the penetration-anchor line and the second connecting part being provided with means, being spaced from each other, for connection with the upper ends of the shank wires.

28. The anchor according to claim 27, wherein the first connecting part and/or the second connecting part comprises an oblong plate or plates.

29. The anchor according to claim 27, wherein the disconnectable connection is formed by a tenon and mortise connection, the tenon being connected to the lower end of an auxiliary line.

30. The anchor according to claim 27, wherein the second connecting part is provided with more than two means, spaced from each other, for connecting with the upper ends of the shank wire means.

31. The anchor according to claim 23, wherein said movable connecting member comprises wires.

32. The anchor according to claim 23, wherein said movable connecting member comprises chains.

33. Anchor fluke having a front edge for penetration, side edges, a rear edge and a longitudinal plane of symmetry intersecting these edges, comprising means for attachment of connecting means to a penetration anchor line, the fluke having an upper side which, in a front portion of that upper side connecting to the front edge and having two areas situated on either side of said plane of symmetry, extends from that front edge according to a convex path which ascends in longitudinal direction as well as according to paths that ascend in transverse direction in a direction away from the plane of symmetry, when the fluke is considered in a state in which it is deposited on a flat horizontal base with its upper side above, wherein the front edge and the connecting front portions of the side edges define a W-shape, a central point of said W-shape being located rearward from the two points on either side thereof.

* * * * *